United States Patent [19]

Buchanan

[11] Patent Number: 4,721,491

[45] Date of Patent: Jan. 26, 1988

[54] BALLOON INFLATION VALVE

[75] Inventor: Bradley H. Buchanan, San Francisco, Calif.

[73] Assignee: M & D Industries, Inc., Brisbane, Calif.

[21] Appl. No.: 941,616

[22] Filed: Dec. 15, 1986

[51] Int. Cl.[4] ..... A63H 27/10; F16K 31/00

[52] U.S. Cl. ..... 446/222; 446/224; 251/353

[58] Field of Search ..... 446/222, 224; 251/343, 251/344, 349, 353

[56] References Cited

U.S. PATENT DOCUMENTS

| | | | |
|---|---|---|---|
| 1,478,757 | 12/1923 | O'Connor | 446/222 |
| 2,651,879 | 9/1953 | Longino | 446/222 |
| 2,710,622 | 6/1955 | Chupa | 446/222 |
| 2,792,669 | 5/1957 | Jackson et al. | 446/224 |
| 2,859,932 | 11/1958 | Mackal | 446/222 |
| 2,940,467 | 6/1960 | Smith | 251/344 |
| 3,859,985 | 1/1975 | Eckhart | 251/344 |
| 3,871,422 | 3/1975 | Elson et al. | 446/222 |
| 4,034,501 | 7/1977 | Zeyra | 446/224 |
| 4,134,416 | 1/1979 | Lallement et al. | 251/353 |
| 4,586,910 | 5/1986 | Buchanan | 446/224 |

FOREIGN PATENT DOCUMENTS

| | | | |
|---|---|---|---|
| 0170181 | 2/1986 | European Pat. Off. | 446/224 |
| 2635922 | 2/1978 | Fed. Rep. of Germany | 251/343 |
| 2635923 | 2/1978 | Fed. Rep. of Germany | 251/343 |
| 1307402 | 2/1973 | United Kingdom | 251/344 |
| 2093709 | 9/1982 | United Kingdom | 446/222 |

*Primary Examiner*—Robert A. Hafer
*Assistant Examiner*—Charles H. Harris
*Attorney, Agent, or Firm*—Phillips, Moore, Lempio & Finley

[57] ABSTRACT

An inflation valve, adapted for sealed attachment within a stem of a balloon, includes a valve body defining a longitudinal passage for receiving a fill tube therein, such as a straw. Insertion of an open distal end of the fill tube to a first position within the passage will facilitate communication of a pressurized fluid, such as air or helium, through a fill port defined in the valve body and into the inflation chamber of the balloon. After filling, the fill tube is moved axially forwardly to a second position for sealing-off communication of the open distal end of the fill tube with the fill port.

20 Claims, 7 Drawing Figures

VI
VII
V

BALLOON INFLATION VALVE

TECHNICAL FIELD

This invention relates generally to an inflation valve and more particularly to an inflation valve adapted to fill a toy balloon or other inflatable member with a gas.

BACKGROUND ART

Various types of valves are available for inflating toy balloons. It is desirable that the inflation valve be non-complex in construction and easy to operate, even by a child, whereby the balloon can be filled expeditiously and efficiently. Applicant's U.S. Pat. No. 4,586,910 discloses an inflation valve of this type. In certain commercial applications, it has proven desirable to provide hand-held balloons with a "stick" for which inflation valves of the above type are not particularly adapted.

DISCLOSURE OF INVENTION

An object of this invention is to provide a highly efficient and dependable inflation valve for balloons and the like.

The inflation valve comprises a valve body defining an elongated passage and at least one fill port communicating with the passage. A fill tube is insertible into the passage for movement from a first position communicating an open distal end of the fill tube with the fill port and a second longitudinally displaced position for closing and sealing-off communication of the open distal end of the fill tube with the fill port.

The fill port is formed through a sidewall of the valve body, transversely of the passage and longitudinally between first and second sealing means disposed in the passage. The first and second sealing means apply sealing pressure radially inwardly on the fill tube to effect the above connumicating and closing functions.

BRIEF DESCRIPTION OF THE DRAWINGS

Other objects and advantages of this invention will become apparent from the following description and accompanying drawings wherein.

BEST MODE OF CARRYING OUT THE INVENTION

General Description

Figure 1:
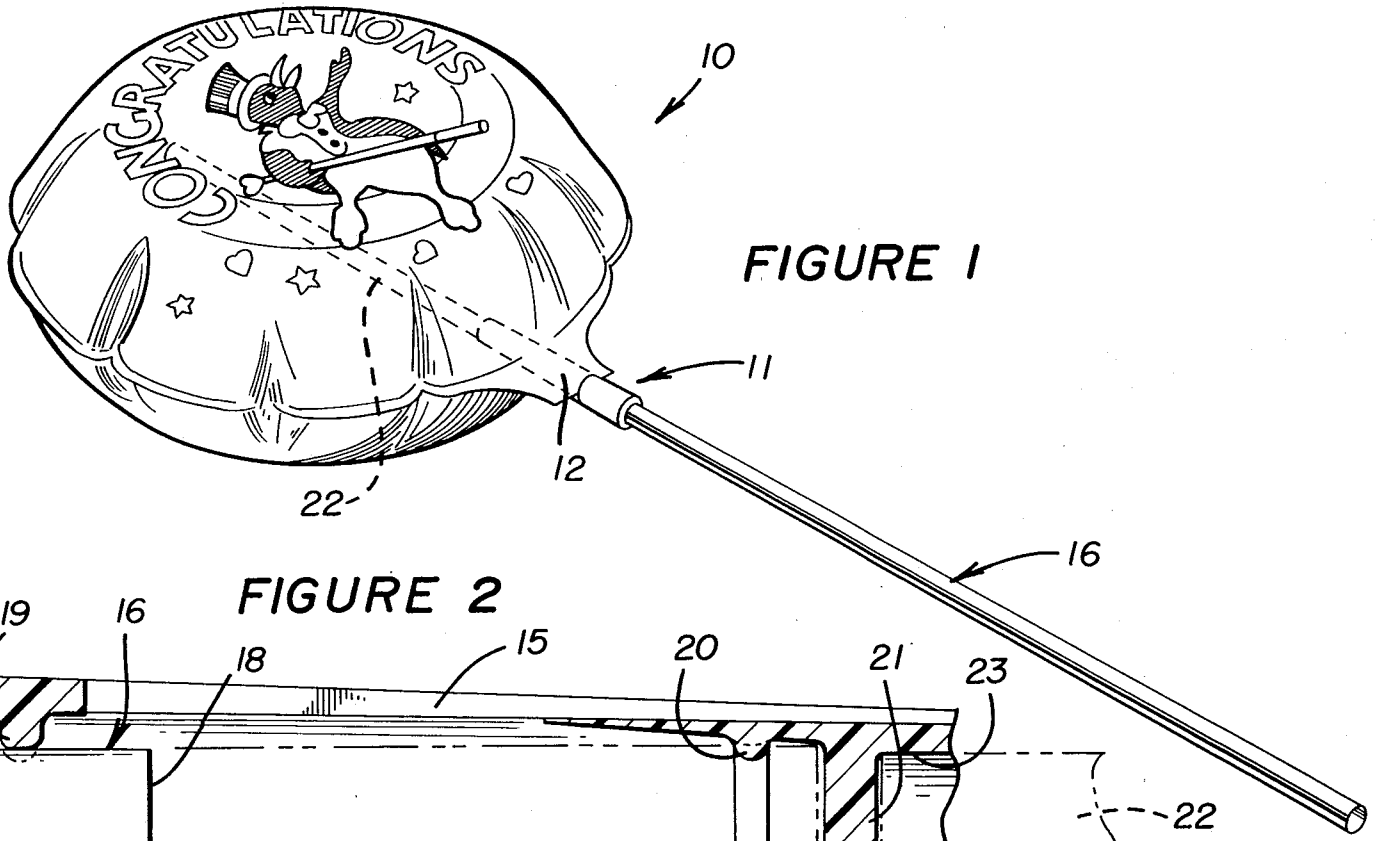
FIG. 1 illustrates a toy balloon having an inflation valve of this invention attached thereto.

FIG. 1 illustrates a metallicized balloon 10 having an inflation valve 11 secured in sealing relationship within a stem 12 of the balloon. The balloon may comprise a pair of superimposed and heat-sealed panels each composed of a composite laminate, such as an exterior layer of aluminum, an intermediate layer of suitable plastic and an inner layer of a heat-sealable coating, such as polyethylene. Composite laminates of this type are well-known in the art, as exemplified by those disclosed in U.S. Pat. No. 4,077,588. Other types of balloon material, such as rubber, are also contemplated for use with the inflation valve.

Figure 2:
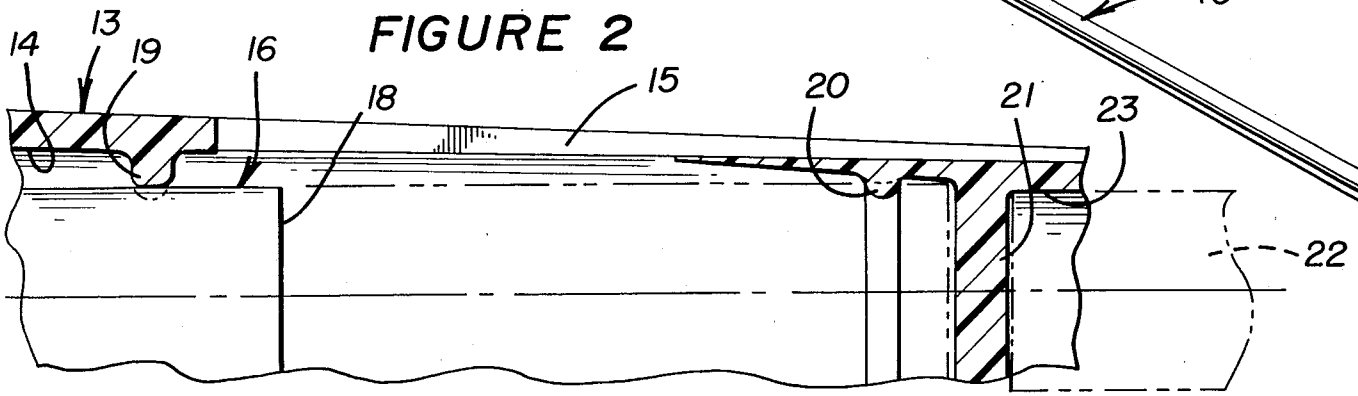
FIG. 2 is an enlarged sectional view illustrating an intermediate portion of the inflation valve.
Figures 3, 4, 5, 6, 7:
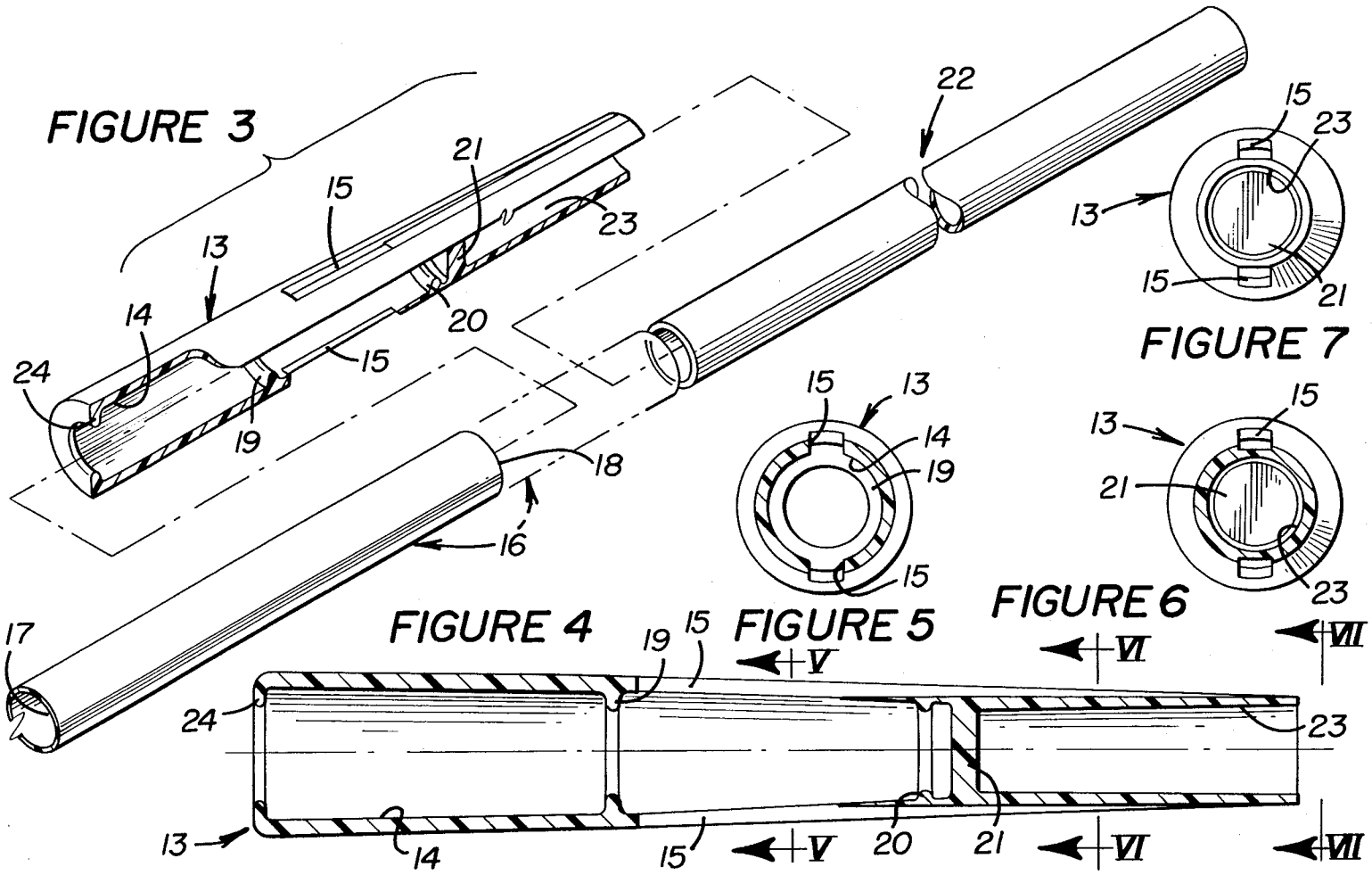
FIG. 3 is an exploded isometric view illustrating a valve body of the inflation valve in partial section and attendant fill and support tubes.
FIG. 4 is a longitudinal sectional view of the valve body.
FIGS. 5–7 are cross-sectional views through the valve body, taken in the directions of arrows V—V, VI—VI, and VII—VII, respectively in FIG. 4.

Referring to FIGS. 2–4, inflation valve 11 comprises a tubular valve body 13 having an elongated and longitudinally extending passage 14 defined therein. At least one fill port 15 communicates with the passage and further communicates directly with the inflation chamber of the balloon. In the embodiment illustrated, a pair of diametrically opposed fill ports 15 are formed through a sidewall of the tubular valve body. The valve body is adapted to be injection molded from a suitable polymer, such as a standard low density polyethylene material.

Inflation valve 11 further comprises a fill tube 16, that defines a conduit or fill passage 17 terminating at a distal open end 18 of the fill tube. As shown in FIG. 2, the fill tube is insertible into passage 14 for movement from its solid line first position to its phantom line second position, longitudinally displaced from the first position. When the fill tube is in its first position, a pressurized fluid (e.g., blown air) is communicated through passage 17 and fill ports 15 to fill the balloon. The fill tube is then moved to its second position to seal-off communication of open distal end 18 of the fill tube with the fill ports.

When the fill tube is in its first position, a deformable first annular bead seal 19 functions as first sealing means circumventing the fill tube in sealing relationship for maintaining distal end 18 of the fill tube in open and sole communication with fill ports 15 and for preventing leakage past bead seal 19. A deformable second annular bead seal 20 provides second sealing means circumventing the fill tube in sealing relationship for sealing-off communication of the open distal end of the fill tube with the fill ports. A disc-shaped partition 21 is disposed in passage 14 on a downstream side of bead seal 20 and functions as a stop, engaging the distal end of the fill tube to delimit it further movement.

If so desired, a conventional balloon support tube or rod 22 can be inserted within an accommodating tubular socket 23, defined on a downstream side of partition 21 and at a distal end of valve body 13 (FIGS. 1 and 3).

DETAILED DESCRIPTION

Referring to FIGS. 3–7, generally cylindrical valve body 13 is preferably composed of a standard injection moldable semi-rigid polymer, such as a low density polyethylene material. The material should exhibit sufficient flexibility and softness to slightly deform to provide the annular sealing desiderata between fill tube 16 and internal bead seals 19 and 20. An annular guide ring 24 is formed internally at a proximal end of valve body 13 to guide longitudinal movement fill tube 16 when it is manually inserted into passage 14. The fill tube, which further functions as a handle for the balloon, may be composed of any suitable semi-rigid or rigid plastic, metal or paper straw material.

As shown in FIG. 3, the outer surface of the valve body is preferably tapered-down from its proximal end towards its distal end. Such taper may comprise three distinct and interconnected tapered sections, namely, a first section extending from the proximal end of the valve body to its termination adjacent to annular bead seal 19 (e.g., 1° taper), a second section extending from adjacent to bead seal 19 to its termination adjacent to bead seal 20 (e.g., 2.5° taper), and a third section extending from adjacent to bead seal 20 to the distal end of the valve body.

Fill tube 16 is cylindrical and has an outside diameter identical to the inside diameter of annular guide ring 24 (e.g., 0.210 in.). The inside diameters of normally relaxed bead seals 19 and 20 are preferably slightly less (e.g., 0.192 in.) than the outside diameter of the fill tube, to facilitate the slight deformation of the bead seals and their intimate sealing contacts around the fill tube, as shown in FIG. 2.

Diametrically opposed fill ports 15 are each shown in the form of a longitudinally extending slot that tapers-down (in cross-section when viewed in FIG. 4) from a point adjacent to a downstream side of bead seal 19 to the distal end of the valve body. As further shown in FIG. 4, the longitudinally extending portions of the slots, located between bead seals 19 and 20, are formed radially through the wall of the valve body to freely communicate the pressurized fluid medium within the balloon. As generally shown in FIG. 1, stem 12 of the balloon is slip-fit in sealing relationship over the proximal portion of the valve body, located on an upstream side of bead seal 19, so as not to cover fill ports 15 and obstruct such filling of the balloon. The tapered outer surface of the valve body facilitates insertion of the valve body into sealing relationship within the stem which stretches slightly to provide the seal.

In use, a person is enabled to insert fill tube 16 into passage 14 of the valve body to its solid line first position shown in FIG. 2 and blow-up the balloon with lung power. Alternatively, a standard fitting could be attached to the open proximal end of the fill tube to fill the balloon from a standard pressurized gas source (e.g., air or helium). After filling, the fill tube is moved to its phantom line second position in FIG. 2 whereby the distal end of the fill tube will engage partition 21 to precisely position and delimit further insertion of the fill tube and permit sealing-off of fill ports 15 from open distal end 18 of the fill tube by means of bead seal 20.

It should be understood that the fill tube could be substantially shortened to have its proximal end terminate closely adjacent to (or even within) guide ring 24. This arrangement would be useful in those commercial applications wherein "free-floating" balloons are filled with helium gas and are not hand-held. The valve is also useful with other types of inflatable members, such as beach balls, footballs, soccer balls and the like.

I claim:

1. An inflation valve for filling an inflatable member with a pressurized fluid comprising a valve body defining a longitudinal passage and at least one fill port communicating with said passage, said fill port formed through a sidewall of said body transversely of said passage, fill tube means, defining a conduit having an open distal end, insertable into said passage for movement from a first position to a second position longitudinally displaced from said first position, first sealing means disposed in said passage for applying sealing pressure radially inwardly on said fill tube means for maintaining said open distal end in open communication with said fill port when said tube means is in its first position, and second sealing means disposed in said passage for applying sealing pressure radially inwardly on said fill tube means for sealing-off communication of said open distal end with said fill port when said tube means is moved to its second position, said fill port being positioned longitudinally between said first and second sealing means.

2. The inflation valve of claim 1 wherein said valve body and passage are generally cylindrical and said fill tube means comprises a cylindrical fill tube.

3. The inflation valve of claim 1 wherein said first and second sealing means comprise first and second annular bead seals, respectively, formed internally and in longitudinally spaced relationship relative to each other within the passage of said valve body.

4. The inflation valve of claim 3 wherein each of said first and second bead seals are composed of a deformable plastic material and wherein said fill tube is cylindrical and has an outer diameter slightly greater than inner diameters of said first and second bead seals whereby insertion of said fill tube through said first and second bead seals will deform said first and second bead seals into sealing relationship about said fill tube.

5. The inflation valve of claim 4 further comprising an annular guide ring, formed internally within said passage at a proximal end of said valve body, having an inside diameter at least closely corresponding to the outside diameter of said fill tube.

6. The inflation valve of claim 3 further comprising partition means secured within said passage on a downstream side of said second bead seal for engaging a distal end of said fill tube means when said fill tube means is moved to its second position.

7. The inflation valve of claim 6 further comprising a tubular socket formed within said valve body on a downstream side of said partition means adapted to receive a support tube or rod therein.

8. The inflation valve of claim 3 wherein said fill port comprises an elongated slot formed through said valve body and extending longitudinally between said first and second bead seals.

9. The inflation valve of claim 8 wherein a pair of said slots are formed radially through said valve body and are diametrically disposed thereon, relative to each other.

10. The inflation valve of claim 8 wherein said slot tapers downwardly, when said valve body is viewed in longitudinal cross-section, from said first annular bead towards a distal end of said valve body.

11. The inflation valve of claim 1 wherein said valve body tapers downwardly from a proximal end towards a distal end thereof.

12. The inflation valve of claim 1 wherein said inflatable member comprises a balloon having an inflatable chamber and a stem, said valve body mounted in sealing relationship within said stem to communicate said fill port with said inflation chamber.

13. A balloon having an inflatable chamber defined therein and an inflation valve mounted in sealing relationship within a stem of said balloon for selectively inflating said chamber with a pressurized fluid, said inflation valve comprising a generally cylindrical valve body secured within the stem of said balloon, said valve body defining an elongated and longitudinally extending passage and at least one fill port, formed through a sidewall of said valve body transversely of said passage, intercommunicating with said passage and the inflatable chamber of said balloon, a fill tube reciprocally mounted in said passage and having an open distal end movable from a first position to a second position, longitudinally displaced from said first position, an annular and deformable first bead seal formed internally within the passage of said valve body to project radially inwardly into sealing relationship about said fill tube when the open distal end of said fill tube is in each of its first and second positions and longitudinally positioned within said passage to communicate the open distal end of said fill tube with said fill port when said distal end is in its first position, and a second annular and deformable bead seal formed internally within the passage of said valve body to project radially inwardly into sealing relationship about said fill tube when the open distal end of said fill tube is in its second position to seal-off communication of the open distal end of said fill tube with said fill port, said fill port positioned longitudinally between said first and second bead seals.

14. The balloon of claim 1 wherein said valve body and passage are generally cylindrical and said fill tube is cylindrical.

15. The balloon of claim 14 wherein each of said first and second bead seals are composed of a deformable plastic material and wherein said fill tube has an outer diameter slightly greater than an inner diameter of each of said first and second bead seals whereby insertion of said fill tube through said first and second bead seals will deform said first and second bead seals into sealing relationship about said fill tube.

16. The balloon of claim 15 further comprising an annular guide ring, formed internally within said passage at a proximal end of said valve body, having an inside diameter at least closely corresponding to the outside diameter of said fill tube.

17. The balloon of claim 13 further comprising partition means secured within said passage on a downstream side of said second bead seal for engaging a distal end of said fill tube when the open distal end of said fill tube is moved to its second position.

18. The balloon of claim 17 further comprising a tubular socket formed within said valve body on a downstream side of said partition means and having a support tube or rod mounted therein and extending into the inflation chamber of said balloon.

19. The balloon of claim 13 wherein a pair of said fill ports are formed radially through said valve body and are diametrically disposd thereon, relative to each other.

20. The balloon of claim 13 wherein said fill port comprises a slot tapering downwardly, when viewed in longitudinal cross-section, from said first annular bead towards a distal end of said valve body.

* * * * *